US005374805A

United States Patent [19]

DiFranco

[11] Patent Number: 5,374,805

[45] Date of Patent: Dec. 20, 1994

[54] METHOD FOR MAKING A NOVELTY ITEM AND THE NOVELTY ITEM THEREFROM

[76] Inventor: Domenico DiFranco, 41 Gort Avenue, Etobicoke, Ontario, Canada, M9W 3Y7

[21] Appl. No.: 196,739

[22] Filed: Feb. 15, 1994

Related U.S. Application Data

[62] Division of Ser. No. 806,390, Dec. 13, 1991, Pat. No. 5,327,666.

[51] Int. Cl.[5] ..... B23K 26/00

[52] U.S. Cl. ..... 219/121.72

[58] Field of Search ..... 219/121.67, 121.72

[56] References Cited

U.S. PATENT DOCUMENTS 4,625,093 11/1986 Chryssolouris ..... 219/121.69
5,051,559 9/1991 Wells ..... 219/121.72
5,145,937 9/1992 Babel et al. ..... 219/121.68
5,247,923 9/1993 Lebourg .

*Primary Examiner*—C. L. Albritton
*Attorney, Agent, or Firm*—Jeffrey T. Imai; Arne I. Fors; D. Doak Horne

[57] ABSTRACT

A novelty item is disclosed comprising a solid block of material having an slug having a first and second finger. The slug is surrounded by the block and adapted to be retained by the block. The first finger has divergent walls cut at a first angle to the top surface of the block. The second finger has convergent walls cut at a second angle to the top surface of the block and the remainder of the slug has walls cut at substantially right angles to the top surface freeing the slug from the block, whereby the thickness of the cut is less than the ratio of the thickness of the block to the tangent of the greater of the first and second angle.

10 Claims, 2 Drawing Sheets

A-A

METHOD FOR MAKING A NOVELTY ITEM AND THE NOVELTY ITEM THEREFROM

This application is a divisional application of Ser. No. 07/806,390, filed Dec. 13, 1991, now U.S. Pat. No. 5,327,666.

FIELD OF INVENTION

This invention relates to a method making a novelty item and the novelty item made therefrom. In particular this invention relates to cutting an slug from a block from wherein the slug is permitted to move relative to the block but is unable to be removed therefrom.

BACKGROUND OF INVENTION

Novelty items, such as key chains, come in a variety of forms. One popular form for a key chain is to have a letter of the alphabet hanging from the key ring. The letter was either cut from a die stock or moulded in the shape of the letter or the die stock with the letter cut therein and removed. These are two of the available methods for manufacturing novelty items such key chains.

OBJECTS OF THE INVENTION

It is an object of this invention to provide a method of cutting a stock of material for manufacturing novelty item and the novelty item made therefrom.

According to one aspect of the invention, there is provided a method of manufacturing a novelty item comprising a solid block of material having an slug having a first and second finger. The slug is surrounded by the block and adapted to be retained by the block. The method comprising the steps of:

cutting opposite edges of the first finger at a first angle to the top surface of the block forming divergent walls, cutting opposite edges of the second finger at a second angle to the top surface of the block forming convergent walls, cutting the remainder of the slug at substantially right angles to the top surface freeing the slug from the block, whereby the thickness of the cut is less than the ratio of the thickness of the block to the tangent of the greater of the first and second angle.

According to another aspect of the invention, there is provided a novelty item comprising a solid block of material having an slug having a first and second finger. The slug is surrounded by the block and adapted to be retained by the block. The first finger has divergent walls cut at a first angle to the top surface of the block. The second finger has convergent walls cut at a second angle to the top surface of the block and the remainder of the slug has walls cut at substantially right angles to the top surface freeing the slug from the block, whereby the thickness of the cut is less than the ratio of the thickness of the block to the tangent of the greater of the first and second angle.

According to still yet a further object of the invention, there is provided a method of manufacturing a novelty item comprising a solid block of material having an slug. The slug is surrounded by the block and adapted to be retained by the block. The method comprising the steps of:

cutting to a predetermined depth the edges of the slug from the top surface of the block at an angle thereto, cutting to the predetermined depth the edges of the slug from the bottom surface of the block at the angle to the bottom surface freeing the slug from the block, whereby the thickness of the cut is less than the ratio of the thickness of the block to the tangent of the angle.

According to still yet another aspect of the invention, there is provided a novelty item comprising a solid block of material having an slug. The slug is surrounded by the block and adapted to be retained by the block. The slug has edges cut to a predetermined depth from the top surface of the block at an angle thereto and edges cut to the predetermined depth from the bottom surface of the block at the angle to the bottom surface freeing the slug from the block, whereby the thickness of the cut is less than the ratio of the thickness of the block to the tangent of the angle.

According to still yet another aspect of the invention, there is provided a method of manufacturing a novelty item comprising a solid block of material having an slug having a first and second end region. The slug is surrounded by the block and adapted to be retained by the block. The method comprising the steps of:

cutting opposite edges of the first end region at a first angle to the top surface of the block, cutting opposite edges of the second end region at a second angle to the top surface of the block, cutting the remainder of the slug at substantially right angles to the top surface freeing the slug from the block, whereby the thickness of the cut is less than the ratio of the thickness of the block to the tangent of the greater of the first and second angle.

BRIEF DESCRIPTION OF THE DRAWINGS

According to the drawings which illustrate the preferred embodiment of the invention.

DETAILED DESCRIPTION OF THE INVENTION

Figure 1:
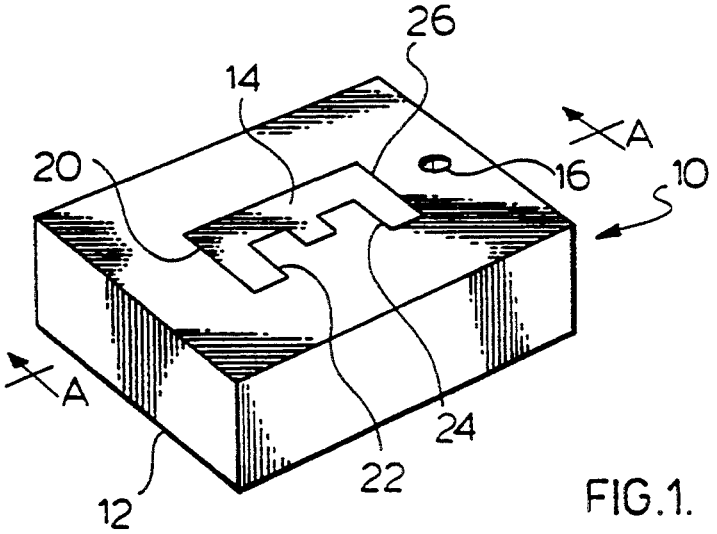
FIG. 1 is a perspective view of the preferred embodiment of the invention.
Figure 2:
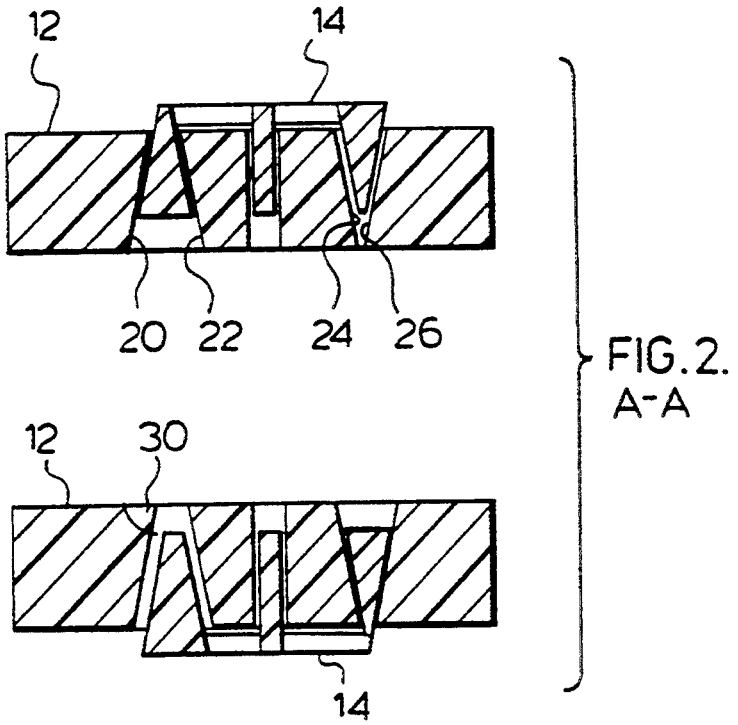
FIG. 2 is a sectional view of the embodiment of FIG. 1 along the lines of A—A.
Figure 3:
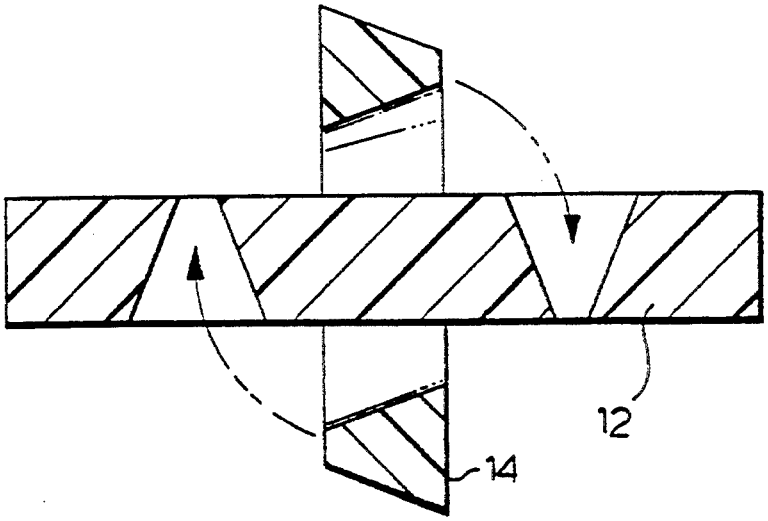
FIG. 3 is a cross sectional view of the embodiment of FIG. 1 with the slug in the shape of the letter C being rotated.

The invention is generally illustrated in FIG. 1 as 10. The invention comprises a block 12 of solid material, a slug 14 cut therein and a hole 16 for receiving a ring or key chain.

In FIG. 1 slug 14 is illustrated as the letter E. However, it is understood that any letter of the alphabet, numeral or design may be used within the spirit and scope of this invention.

The letter E is to be cut in the upper face of block 12. The cut is performed by way of a wire cutter or a high pressure water jet so that the slug 14 will become landlocked. In other words, there is no cut from the outer edge of block 12 as the slug 14 is surrounded by the block 12. All of the cuts which are necessary to define the letter E of slug 14 are made substantially perpendicular to the face of the block, with the exception for cuts 20, 22, 24 and 26.

Cuts 20 and 22 have an opposed angle diverging outwardly from the upper surface. Conversely, cuts 24 and 26 have an opposed angle which converge away from the upper surface. The cutting action will create a certain amount of clearance between the block 12 and slug 14 which allow the slug to move freely relative to the block material once all cuts have been completed. However, due to the opposed angles of cuts 20 and 22 and cuts 24 and 26, slug 14 will be able to move upwardly relative to the block 12 until the lower arm of letter E wedges in cuts 20 and 22. Conversely, the letter E is able to move downwardly relative to the block 12 until the upper arm of letter E wedges against cuts 24 and 26. The slug 14 is free to move relative to the block it is unable to be removed completely from the block 12.

As is apparent, the angle of cuts 20 and 22 and cuts 24 and 26 depend on the thickness of block 12 and the thickness of the cutting apparatus for making such cuts and hence defining the amount of clearance between slug 14 and block 12. If the angle 30 is not sufficient with respect to the thickness of the block 12 and the clearance between block 12 and slug 14 the slug will be removable from the block 12. The thickness of the cut is less than the ratio of the thickness of the block 12 to the tangent of the angle 30.

In FIG. 1, the angle 30 is illustrated to be the same for each of the cuts 20, 22, 24 and 26. However, these cuts need not be made at the same angle. The angle of the cutting apparatus can be maintained for ease of manufacture.

Aesthetically, the slug can be raised relative to the block which gives a very defined appearance. Conversely, the slug can be recessed relative to the block providing a dramatically different appearance. Further, in certain configurations of the slug 14, such as the letter C, the letter will be almost completely removable when rotated in one direction but will provide the desired effect when rotated in the opposite direction.

Figure 4:
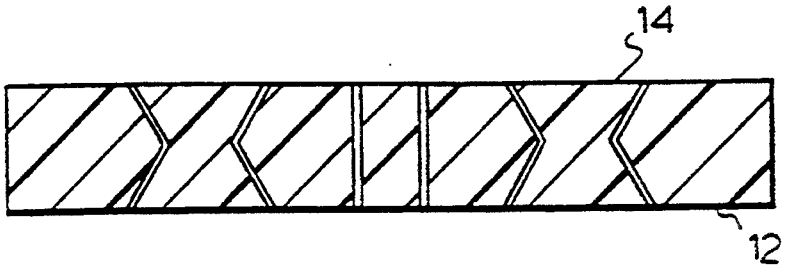
FIG. 4 is a cross sectional view of the embodiment of FIG. 1 using the second method.

In a second embodiment as illustrated in FIG. 4, a laser cutter may be used to make the angled cuts. However, the cuts may be made to a particular depth and making cuts from opposite sides using opposed angles. This method has the advantage that both sides of the block 12 have the same dimensions for the slug 14. Further, almost any shape for slug 14 may be cut using this method.

Figure 5:
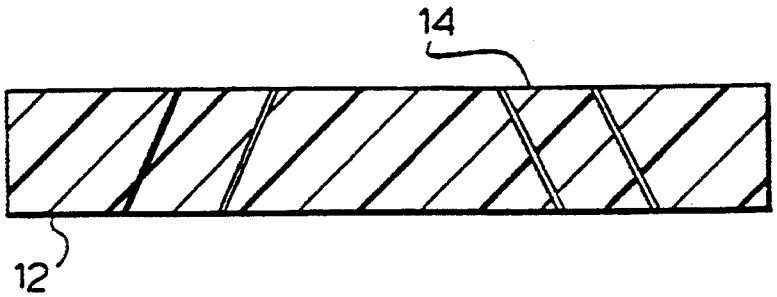
FIG. 5 is a cross sectional view of the embodiment of FIG. 1 using a third method with the slug in the shape of a letter C.

In a third embodiment as illustrated in FIG. 5, the cuts at one end region of the slug are substantially parallel to each other at a first angle. The cuts at the second end region of the slug are substantially parallel to each other at a second complimentary angle. The slug will be freely slidable within the confines of the block but will not be removable therefrom.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

I claim:

1. A method of manufacturing a novelty item comprising a solid block of material having an slug having a first and second end region, said slug surrounded by said block and adapted to be retained by said block, said method comprising the steps of:

cutting opposite edges of said first end region at a first angle to the top surface of said block, cutting opposite edges of said second end region at a second angle to the top surface of the block, cutting the remainder of the slug at substantially right angles to the top surface fleeing the slug from the block, whereby the thickness of the cut is less than the ratio of the thickness of the block to the tangent of the greater of the first and second angle.

2. A method as claimed in claim 1 wherein said cuts at said first and second end regions are substantially parallel and said first and second angles are complementary.

3. A method as claimed in claim 1 wherein said cuts at said first end region form convergent walls and said cuts at said second end region form divergent walls.

4. A method as claimed in claim 3 wherein said first and second angles are equal.

5. A method as claimed in claim 3 wherein said slug is configured in the shape of a letter of the alphabet when viewed in plan view.

6. A method as claimed in claim 3 wherein said slug is configured in the shape of a numeral when viewed in plan view.

7. A method of manufacturing a novelty item comprising a solid block of material having an slug, said slug surrounded by said block and adapted to be retained by said block, said method comprising the steps of:

cutting to a predetermined depth the edges of said slug from the top surface of said block at an angle thereto, cutting to said predetermined depth the edges of said slug from the bottom surface of said block at said angle to the bottom surface freeing the slug from the block, whereby the thickness of the cut is less than the ratio of the thickness of the block to the tangent of the angle.

8. A method as claimed in claim 7 wherein said cuts are formed by a laser cutter.

9. A method as claimed in claim 7 wherein said slug is configured in the shape of a letter of the alphabet when viewed in plan view.

10. A method as claimed in claim 7 wherein said slug is configured in the shape of a numeral when viewed in plan view.

* * * * *